US005323521A

United States Patent [19]

Freund et al.

[11] Patent Number: 5,323,521

[45] Date of Patent: Jun. 28, 1994

[54] HAND RIVETING TOOL

[75] Inventors: Lothar Freund; Roman Subotsch, both of Taunusstein, Fed. Rep. of Germany

[73] Assignee: Maschinenbau Subotsch & Schwab GmbH, Fed. Rep. of Germany

[21] Appl. No.: 964,358

[22] Filed: Oct. 21, 1992

[30] Foreign Application Priority Data

Dec. 13, 1991 [DE] Fed. Rep. of Germany ... 9115444[U]

[51] Int. Cl.[5] ..... B23P 11/00; B21J 15/04

[52] U.S. Cl. ..... 29/243.527; 72/391.4

[58] Field of Search ..... 72/391.4; 29/243.527

[56] References Cited

U.S. PATENT DOCUMENTS

| | | | |
|---|---|---|---|
| 3,548,627 | 12/1970 | Henshaw | 29/243.527 |
| 4,137,747 | 2/1979 | Clarke et al. | 29/243.521 |
| 4,653,308 | 3/1987 | Gregory | 29/243.527 |
| 5,079,818 | 1/1992 | Schwab | 29/243.527 |

FOREIGN PATENT DOCUMENTS

| | | | |
|---|---|---|---|
| 0130756 | 5/1978 | Fed. Rep. of Germany | 29/243.527 |
| 4215603 | 3/1993 | Fed. Rep. of Germany | 29/243.527 |
| 2122716 | 1/1984 | United Kingdom | 29/243.527 |

*Primary Examiner*—David Jones

*Attorney, Agent, or Firm*—Gifford, Groh, Sprinkle, Patmore and Anderson

[57] ABSTRACT

A manually actuable blind riveting tool comprises a housing carrying a sleeve member at the front end thereof. Fixed in the front sleeve member is a mouthpiece member for accommodating a pulling mandrel of a blind rivet while a collet for clamping the pulling mandrel is arranged in the front sleeve member behind the mouthpiece member. The collet is connected to a movable pulling plunger which extends through the housing of the tool and which in its interior has a discharge passage for receiving mandrels after they have been torn off a respective rivet. Two pivotal levers are mounted on the housing for applying an axial force to the pulling plunger to produce a stroke movement thereof during the actual riveting operation. The stroke movement of the pulling plunger is adjustable by a variation in the spacing between the mouthpiece member and the collet.

8 Claims, 3 Drawing Sheets

HAND RIVETING TOOL

BACKGROUND OF THE INVENTION

A typical form of manually actuable blind riveting tool comprises a tool housing with a front sleeve or tube which is disposed at the front end of the tool housing and the front end of which carries a mouthpiece member for receiving a pulling mandrel of a rivet. A collet for clamping the pulling mandrel is disposed in the front sleeve or tube member, behind the mouthpiece member and is connected to a movable pulling plunger which extends through the tool housing and which is in the form of a discharge passage for mandrels which have been pulled off. The tool further has two pivotal levers which are mounted laterally on the tool housing, for transmitting an axial force to the pulling mandrel, for the production of a stroke movement during the actual riveting operation.

With such a tool therefore, to carry out a riveting operation, the two levers must first be moved entirely into the fully open position in which they are pivoted away from the tool housing to the greatest possible extent. By virtue of that movement, the pulling plunger is moved forwardly in the tool housing and the clamping collect is opened by virtue of positive co-operation thereof with the mouthpiece member which is of a complementary configuration, so that the pulling mandrel of the blind rivet to be set can then be inserted into the mouthpiece member. The two pivotal levers are then firstly moved towards the closed position again until the pulling mandrel is gripped by the clamping collet as it slides rearwardly in the tool housing. In the actual riveting operation which is now effected, the two pivotal levers are further pressed inwardly towards the tool housing so that an axial force component is applied to the pulling mandrel of the rivet by way of the pulling plunger. As a result, the pulling mandrel breaks off at a predetermined desired-rupture location, thereby forming the rivet setting head.

As the angle to which the pivotal levers having to be opened to carry out the actual riveting step increases with increasing pulling mandrel diameter, in such a blind riveting tool the force required for setting a rivet increases with the size and strength of the blind rivet to be set.

The usual practice in dealing with that problem is to use a set of different blind riveting tools which are adapted to the respective rivet dimensions involved. It is also possible to use blind riveting tools which have an interchangeable front sleeve or tube member, with the amount of force applied to set the rivet being suitably adjusted in dependence on the size and strength of the blind rivet to be set, by using a sleeve or tube member of suitable size.

However, both those situations involve a considerable amount of expenditure on items of equipment as either it is necessary to provide a set of different hand riveting tools, or each hand riveting tool must include a set of for example three or four interchangeable sleeve or tube members of specific sizes and configurations. In addition, in the latter case, interchanging the sleeve or tube members not only takes up a relatively great amount of time, but it is also a nuisance and a burden from the point of view of the operator.

SUMMARY OF THE INVENTION

An object of the present invention is to provide a manually actuable blind riveting tool which avoids the disadvantages set forth above.

Another object of the present invention is to provide a manually actuable blind riveting tool with which blind rivets of different sizes and strengths can be set in a simple fashion, with substantially always the same amount of force being applied, thereby to facilitate the riveting operation and avoid fatigue on the part of the operator as a result of having to apply a very high force.

Still another object of the present invention is to provide a hand blind riveting tool which affords a higher degree of flexibility of use without involving additional apparatus expenditure.

In accordance with the principles of the present invention, the forgoing and other objects are achieved by a manually actuable blind riveting tool comprising a housing and a sleeve means disposed at the front end of the housing. Fixed in the front end of the sleeve means is a mouthpiece member for receiving a pulling mandrel of a rivet to be set. A collect for clamping the pulling mandrel is disposed in the sleeve means behind the mouthpiece member, and a movable pulling member or plunger which extends through the tool housing is connected to the collet, providing in its interior a discharge passage for a torn-away pulling mandrel. First and second pivotal levers are arranged laterally on the tool housing for the transmission of an axial force component to the pulling mandrel, resulting in a stock movement thereof during the actual riveting operation. The tool has means for adjusting the stroke movement of the pulling plunger by varying the spacing between the mouthpiece member and the collet.

As will be seen in greater detail hereinafter, opening of the clamping collet is effected by way of form-locking or position co-operation thereof with the mouthpiece member, so that the angle of opening of the pivotal levers can be set to the optimum adjustment by virtue of the variation in accordance with the invention of the spacing between the mouthpiece member and the clamping collet, in order to achieve the force required for the riveting operation, in dependence on the size and strength of the respective rivet to be set.

In accordance with a preferred feature of the invention the sleeve means can be screwed into the tool housing and can be steplessly arrested in its axial position relative to the clamping collet by means of a lock nut. When setting blind rivets of different diameters, the angle of opening of the pivotal levers can be very easily and rapidly altered, to conform to the respective requirements involved, and the force required for performing the riveting operation can thus be adjusted as desired.

In another preferred feature of the invention the sleeve means, at its rearward end region, has an external screwthread, the diameter of the screwthreaded rearward end region being smaller than that of the front end region thereof so that the front end region acts as an abutment for the lock nut. In that way it is possible to fix the minimum angle of opening of the pivotal levers, which still provides a sufficient stroke movement on the part of the pulling plunger, for satisfactorily carrying out a riveting operation.

In a preferred feature of the invention, only the rear portion of the lock nut is provided with an internal screwthread, the inside diameter of the front unthreaded portion of the lock nut being larger than that of the rear portion and larger than that of the front end region of the sleeve means, which is not provided with a screwthread. In that configuration the end of the screwthreaded rear portion of the sleeve means can be used as a marking means to indicate the position to which the sleeve means can be screwed out of the housing of the tool, without adversely affecting operational safety. As the rear portion of the lock nut, which has the internal screwthread, acts as an abutment for the front sleeve means, the external screwthread of the sleeve means, under normal operating conditions, is therefore always covered by the unthreaded front portion of the lock nut, thereby reliably avoiding any damage to the screwthreaded. The length of the front portion of the lock nut is therefore a measurement in respect of the maximum possible variation in the spacing between the mouthpiece member and the clamping collet. In still another preferred feature of the invention the peripheral surface of the lock nut is adapted to be readily grippable so that it can be better operated manually, being for example milled or knurled.

Another advantageous feature of the invention provides that rotational markings are provided on the sleeve means at the front of the tool.

Further object, features and advantages of the invention will be apparent from the following description of a preferred embodiment.

BRIEF DESCRIPTION OF THE DRAWINGS

FIG. 3 is a view corresponding to that shown in FIG. 2 with the front sleeve member partially screwed in.

DESCRIPTION OF THE PREFERRED EMBODIMENT

Figure 1:
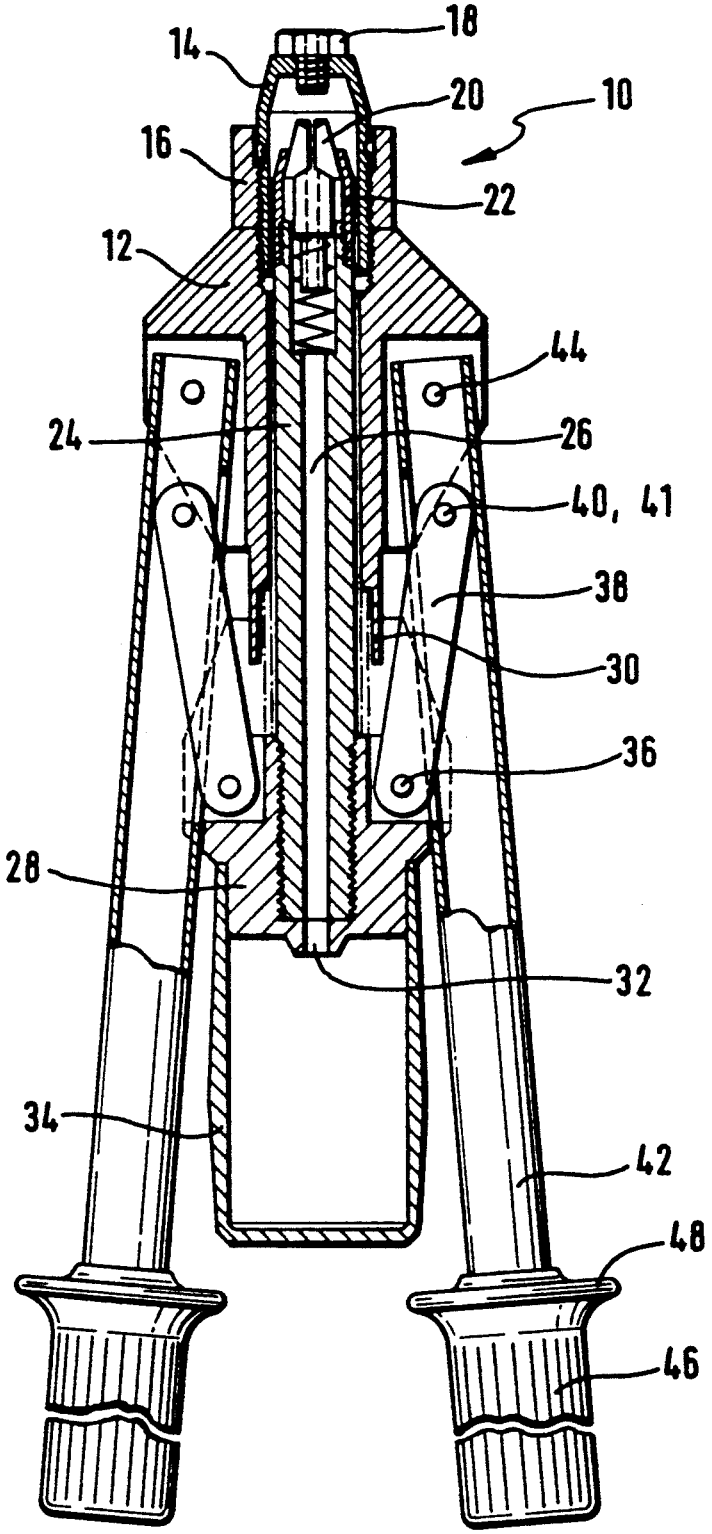
FIG. 1 is a view in section of a blind riveting tool according to the invention.

Referring firstly to FIG. 1, a manually actuable blind riveting tool 10 comprises a tool housing which is generally indicated at 12 and which at its front end (upwardly in FIG. 1) carries a front sleeve or tube member 14 which is arranged in such a way that it can be screwed into and out of same. The sleeve member 14 can be arrested in its axial position relative to the tool housing 12 by means of a lock nut 16. At its rearward end which is downward in FIG. 1 the sleeve member 14 has an external screwthread, the diameter of the region of the sleeve member 14 which has the external screwthread thereon being smaller than the front region thereof, which does not have a screwthread, so that the front region acts as an abutment for the lock nut 16 to prevent movement thereof beyond a certain position. The lock nut 16 is provided with an internal screwthread only in a rearward portion thereof. The inside diameter of the front, unthreaded portion of the lock nut 16 is larger than that of the front unthreaded region of the sleeve member 14 so that the sleeve member 14 can be screwed into the tool housing 12 until it comes to bear against the rear portion of the lock nut 16. Under normal operating conditions therefore the screwthread of the front sleeve member 14 is protected from any damage by the lock nut 16.

The beginning of the region of the sleeve member 14 which is not provided with a screwthread can be used as a marking means, to indicate the position to which the sleeve member 14 can be screwed out of the tool housing 12, without adversely affecting the safety aspect thereof. The peripheral surface of the lock nut 16 is of such a configuration as to be readily grippable, for example milled or knurled, so that it can be satisfactorily operated manually.

Reference numeral 18 indicates a mouthpiece member for receiving a rivet pulling mandrel (not shown), the mouthpiece member 18 being fixed in the tip of the sleeve member 14 which, as can be seen clearly from FIG. 1, tapers in a conical configuration at its front end. The mouthpiece member 18 can be fixedly connected to the sleeve member 14 or it can be replaceably carried therein, for example by means of a screw connection or the like.

A clamping collet 20 for clamping the pulling mandrel is arranged in the sleeve member 14, rearwardly of the mouthpiece member 18. The clamping collet 20 is connected by way of a clamping sleeve 22 to a movable pulling member or plunger 24 which extends through the tool housing 12 and which in its interior is in the form of a discharge passage 26 for torn-away pulling mandrels. The rearward end of the pulling plunger 24 is fixedly connected to a guide housing 28 which is axially slidably disposed on a guide sleeve 30. At its front end, the guide sleeve 30 is fixedly connected to the rear end of the tool housing 12 and surrounds the pulling plunger 24 between the tool housing 12 and the guide housing 28. The discharge passage 26 opens by way of an opening indicated at 32 into a collecting container 34 for torn-away pulling mandrels in order to avoid the risk of injury to the operator due to pulling mandrels lying around. The collecting container 34 is fitted on to the rearward cylindrical end of the guide housing 28. It may also be of such a design configuration however that it can be screwed on to the guide housing 28.

Two tongs legs or connecting link members 38 are laterally mounted to the guide housing 28 by pins 36, at the ends of the connecting link members 38 which are downward in FIG. 1. The other ends of the connecting link members 38 are pivotally connected by means of respective screwthreaded pins 40 and securing nuts 41 to two lateral pivotal levers 42 which at their front ends, being the upward ends in FIG. 1, are mounted to the tool housing 12 by pins 44. The other or rearward ends of the pivotal levers 42 are each provided with handles 46 of a suitable material such as plastic material. The surface of the handles 46 is of a suitable configuration, for example milled or otherwise profiled, to prevent the operator from slipping off during the riveting operation. In addition, in their front region as indicated at 48, they are enlarged in a plate-like configuration to enhance the safety factor involved.

Figure 2:
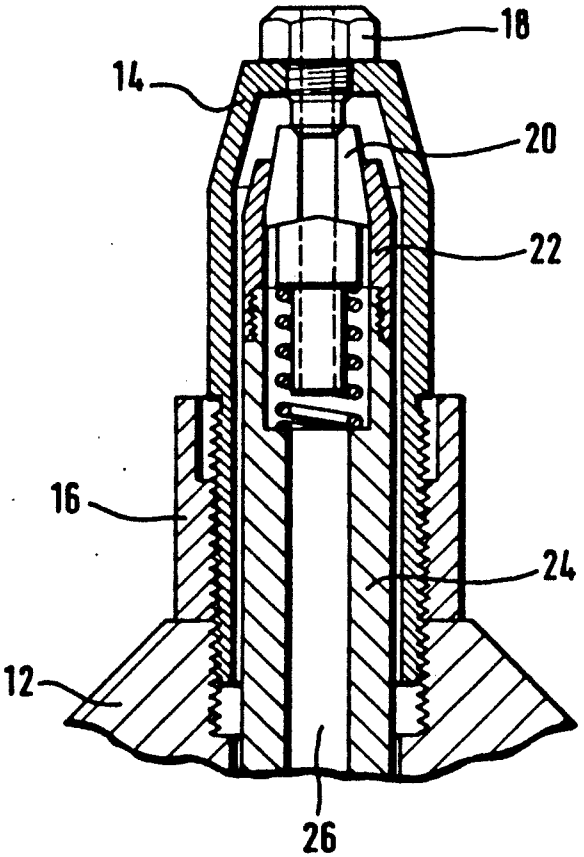
FIG. 2 is a view on an enlarged scale of the front part of the FIG. 1 tool with the pivotal levers in the open position.
Figure 4:
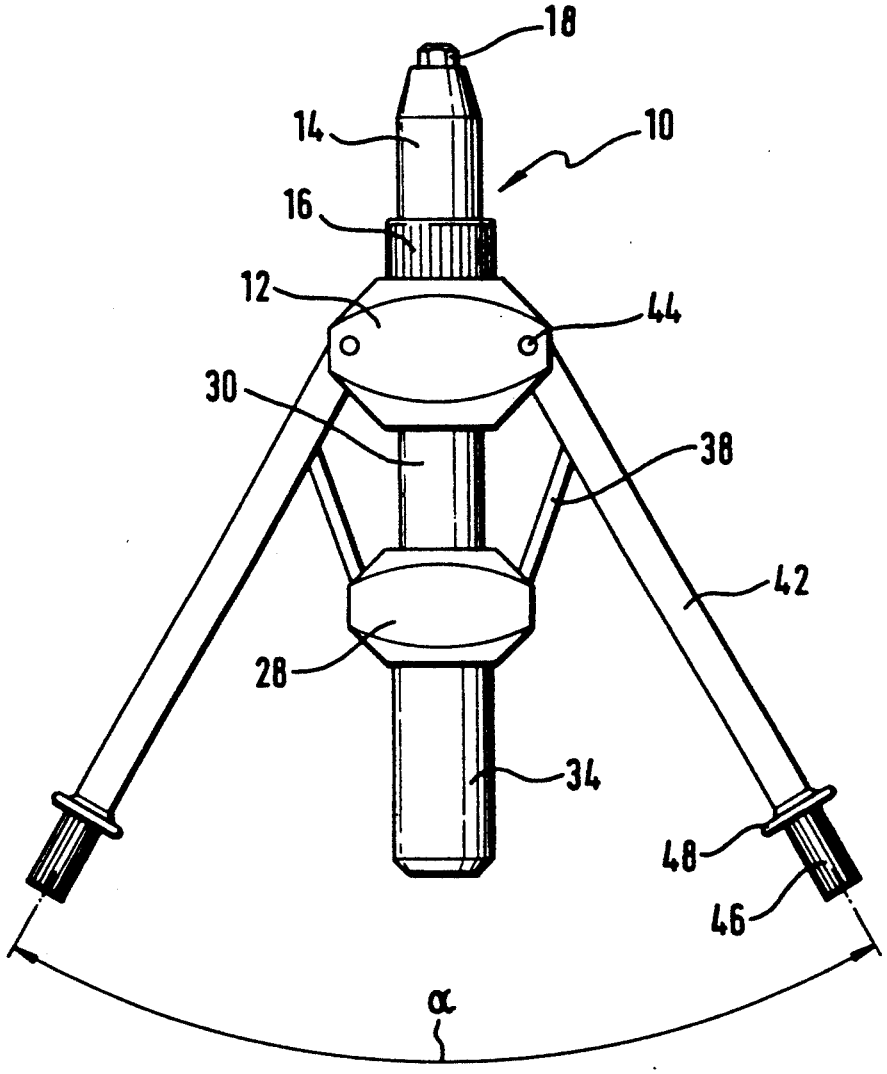
FIG. 4 is a diagrammatic view of a blind riveting tool according to the invention.

Reference will now be made to FIG. 2 showing the front part of the hand riveting tool 10 according to the invention when the pivotal levers 42 are in a completely open position of being pivoted entirely away from the body of the tool housing 12. As a result the pulling plunger 24 is in the foremost position so that the clamping collet 20 is opened by way of a form-locking cooperation with the mouthpiece 18 which is of a complementary configuration, to receive a pulling mandrel (not shown). The sleeve member 14 is screwed out of the tool housing 12 to such an extent that its screwthreaded rear region terminates at the front end of the lock nut 16. In that way the screwthread is reliably protected from any damage. That position at the same time marks the limit position at which the hand riveting tool according to the invention can be used without adverse effect from the safety point of view so that the angle of opening of the pivotal levers 42 as indicated at $\alpha$ in FIG. 4 reaches its maximum value. With the sleeve member 14 in that position therefore only blind rivets of relatively small diameter can be readily set while riveting operations using blind rivets of relatively large diameter can be effected only by applying a large amount of force.

Figure 3:
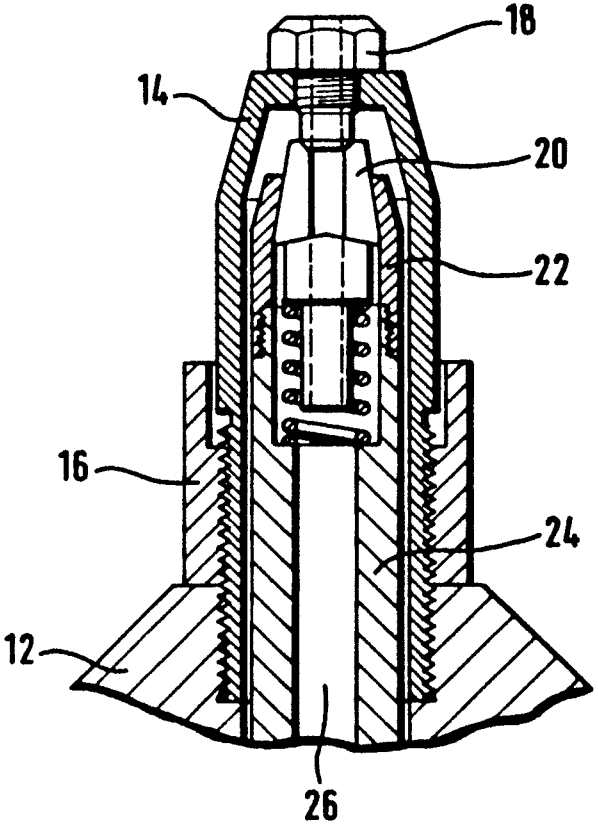

If now the sleeve member 14 is screwed further into the tool housing 12, as shown in FIG. 3, the pulling plunger 24 is earlier to reach its position at which the clamping collet 20 is completely opened by way of its form-locking co-operation with the mouthpiece member 18. The angle of opening $\alpha$ of the pivotal levers 42 is thus less than in the situation shown in FIG. 2 so that it is now possible to pull pulling mandrels of large diameter, with an amount of force which otherwise would be required only for weaker pulling mandrels.

Accordingly, the angle of opening of the pivotal levers 42 which is required for the minimum application of force for carrying out the riveting operation can be specifically set in dependence on the size and strength of the respective pulling mandrel involved.

It will be seen from the foregoing therefore that the present invention provides a hand riveting tool which permits riveting operations with blind rivets of different diameters, in a simple fashion with the application of a force which can be substantially always the same, but without involving additional items of equipment.

It will be appreciated that the above-described embodiment of the tool according to the present invention has been set forth solely by way of example and illustration of the principles thereof and that further modifications and alterations may be made therein without thereby departing from the spirit and scope of the invention.

What is claimed is:

1. A manually actuable blind riveting tool comprising:

a tool housing having a front end, a sleeve member arranged at the front end of the tool housing, the sleeve member having a front end and is threadably engaged with the tool housing, a mouthpiece member at a front end of the sleeve member for receiving a pulling mandrel of a rivet, a collet for clamping the pulling mandrel, the collet arranged in the sleeve member behind the mouthpiece member, a movable pulling plunger which extends through the tool housing and is connected to the collet and provides in an interior of the housing a discharge passage for a torn-away pulling mandrel, a collecting container removably mounted to said housing and opening to said discharge passage for collecting torn-away pulling mandrels, first and second pivotal levers arranged laterally on the tool housing for the transmission of an axial force component to the pulling plunger which results in a stroke movement thereof during a riveting operation, and means for adjusting the stroke movement of the pulling plunger by rotating the sleeve member to vary the spacing between the mouthpiece member and the collet.

2. The blind riveting tool as set forth in claim 1 wherein the sleeve member is adapted to be screwed into the tool housing and further including a lock nut for steplessly arresting the sleeve member in an axial position with respect to the collet.

3. The blind riveting tool as set forth in claim 2 wherein the sleeve member has a rear end region provided with an external screwthread and wherein a diameter of the screwthreaded rear end region of the sleeve member is smaller than that of a front end region thereof so that the front end region acts as an abutment means for the lock nut.

4. The blind riveting tool as set forth in claim 2 wherein a peripheral surface of the lock nut is adapted to be readily grippable.

5. The blind riveting tool as set forth in claim 4 wherein the peripheral surface of the lock nut is milled.

6. The blind riveting tool as set forth in claim 4 wherein the peripheral surface of the lock nut is knurled.

7. The blind riveting tool as set forth in claim 1 including rotational markings on the sleeve member.

8. A manually actuable blind riveting tool, comprising:

a tool housing having a front end, a sleeve member arranged at the front end of the tool housing, the sleeve member having a front end and is threadly engaged with the tool housing, the sleeve member being adapted to be screwed into the tool housing, the sleeve member further having a rear end region provided with an external screwthread and wherein the diameter of the screwthreaded rear end region is smaller than that of an unthreaded front end region thereof, a mouthpiece member at a front end of the sleeve member for receiving a pulling mandrel of a rivet, a collet for clamping the pulling mandrel, the collet arranged in the sleeve member behind the mouthpiece member, a lock nut for steplessly arresting the sleeve member in its axial position with respect to the collet, the lock nut has a front portion and a rear portion, wherein only the rear portion is provided with an internal screwthread, and wherein the inside diameter of the unthreaded front portion is larger than that of the rear portion and is larger than that of the unthreaded front end region of the sleeve member, the front end region acts as an abutment means for the lock nut, a movable pulling plunger which extends through the tool housing and is connected to the collet and provides in an interior of the housing a discharge passage for a torn-away pulling mandrel, first and second pivotal levers arranged laterally on the tool housing for the transmission of an axial force component to the pulling which results in a stroke movement thereof during a riveting operation, and means for adjusting the stoke movement of the pulling plunger by rotating the sleeve member to vary the spacing between the mouthpiece and the collet.

* * * * *

UNITED STATES PATENT AND TRADEMARK OFFICE

CERTIFICATE OF CORRECTION

PATENT NO. : 5,323,521

DATED : June 28, 1994

INVENTOR(S) : Lothar Freund and Roman Subotsch

It is certified that error appears in the above-indentified patent and that said Letters Patent is hereby corrected as shown below:

Column 1, line 43, delete "having" and insert -- have --;

Column 2, line 18, delete "forgoing" and insert -- foregoing --;

Column 2, line 23, delete "collect" and insert -- collet --;

Column 2, line 31, delete "stock" and insert -- stroke --;

Column 2, line 38, delete "position" and insert -- positive --;

Column 3, line 15, delete "screwthreaded" and insert -- screwthread --;

Column 3, line 18, delete "In still" and on line 19, before "another" insert -- In still --;

Column 3, line 26, delete "object" and insert -- objects --;

UNITED STATES PATENT AND TRADEMARK OFFICE

CERTIFICATE OF CORRECTION

PATENT NO. : 5,323,521
DATED : June 28, 1994
INVENTOR(S) : Lothar Freund, et. al.

It is certified that error appears in the above-indentified patent and that said Letters Patent is hereby corrected as shown below:

Column 6, line 32, delete "threadly" and insert -- threadably --.

Signed and Sealed this

Twentieth Day of September, 1994

*Attest:*

*Attesting Officer*

BRUCE LEHMAN

*Commissioner of Patents and Trademarks*